US005657421A

United States Patent [19]

Lorenz et al.

[11] Patent Number: 5,657,421

[45] Date of Patent: Aug. 12, 1997

[54] SPEECH SIGNAL TRANSMITTER WHEREIN CODING IS MAINTAINED DURING SPEECH PAUSES DESPITE SUBSTANTIAL SHUT DOWN OF THE TRANSMITTER

[75] Inventors: Dietmar Lorenz, Erlangen; Karl Hellwig, Nünberg, both of Germany

[73] Assignee: U.S. Philips Corporation, New York, N.Y.

[21] Appl. No.: 353,044

[22] Filed: Dec. 9, 1994

[30] Foreign Application Priority Data

Dec. 13, 1993 [DE] Germany ..... 43 42 425.2

[51] Int. Cl.[6] ..... G10L 9/14

[52] U.S. Cl. ..... 395/2.32; 395/2.28; 395/2.24; 395/2.36; 395/2.37

[58] Field of Search ..... 395/2.35, 2.36, 395/2.37, 2.28, 2.29, 2.3, 2.31, 2.32

[56] References Cited

U.S. PATENT DOCUMENTS 5,457,783 10/1995 Chhatwal ..... 395/2.28

FOREIGN PATENT DOCUMENTS

WO9313516 7/1993 Germany ..... G10L 9/14

9313516 7/1993 WIPO ..... G10L 3/00

OTHER PUBLICATIONS

ICASSP '87, Speech/Silience Segmentation for Real-Time Coding Via Rule Based Adaptive Endpoint Detection. by. J.F. Lynch Jr. et al., pp. 1348–1351, Dallas, TX, USA.

Atal et al., "Advances in Speech Coding", Kluwer Academic Publications, (1991), pp. 69–79.

*Primary Examiner*—Allen R. MacDonald
*Assistant Examiner*—Tālivaldis Ivars Šmits

[57] ABSTRACT

In so-called Code Excited Linear Prediction (CELP) coding methods for speech signal transmission, a codebook look-up method is used which is very processor-intensive. To conserve power, during speech pauses not only the transmitter but also the speech coder is turned off substantially completely. Consequently, when the speech signal resumes there is a transition interval before the filters of the speech coder become adjusted to full operation. For this reason, according to the invention, the filters are not turned off during speech pauses but are directly driven by codebook excitation vectors which correspond to the speech signal then being processed. As a result, there is a smoother and hardly perceptible transition between background noise and the speech signal when the latter resumes. An artificial background noise is produced in the receiver during speech pauses.

6 Claims, 1 Drawing Sheet

SPEECH SIGNAL TRANSMITTER WHEREIN CODING IS MAINTAINED DURING SPEECH PAUSES DESPITE SUBSTANTIAL SHUT DOWN OF THE TRANSMITTER

BACKGROUND OF THE INVENTION

1. Field of the Invention

The invention relates to a transmission system comprising a transmitter, which transmitter includes a speech coder that has a memory arrangement for storing excitation signals, a filter arrangement for filtering the excitation signals, and selection means for comparing a signal derived from the speech signal with the output signal of the filter and based on such comparison selecting the optimum excitation signal. The transmitter further includes a detector for detecting speech pauses and turning off at least parts of the speech coder when a speech pause is detected, and means for transmitting the optimum excitation signal to a receiver. The receiver includes a speech decoder for recovering the optimum excitation signal and the speech signal.

2. Description of the Related Art

Such a method of coded speech transmission is widely known, for example from the text book "Advances in Speech Coding" by Bishnu S. Atal, Vladimir Cuperman, and Allen Gersho, 1991, Klower Acad. Pub., more specifically, pages 69 to 79. This method is especially used in mobile radio for transmitting speech signals between a mobile station and a fixed station. The mobile station is generally battery-operated and, as the transmitter consumes the most power, it and the associated components are turned off during speech pauses to save energy and extend the useful life of the batteries. Due to the highly complex structure of the speech coder, however, the coder requires considerable power. This is especially because all the memory locations of the memory arrangement are to be addressed during each speech frame and all the excitation signals, also termed excitation vectors; are to be filtered to find the optimum excitation vector i.e., the one which provides, for example, the least energy in the difference signal produced by the difference forming stage.

WO 93/13516 describes an arrangement for performing the aforesaid method but without giving details for the speech coder. Therein the speech coder is turned off during speech pauses and only few parameters, i.e. LPC coefficients and autocorrelation coefficients, are further produced, from which parameters the detector detects the speech pauses and also from which parameters information is derived for background noise to be transmitted. It may be assumed that the filter arrangement in the speech coder is then also turned off, because the output signals thereof are not directly necessary during speech pauses. When, however, the speech signal recommences, the filter needs to have a certain time to build up to full intensity after being turned on, so that non-optimum parameters for the transmission of the speech signals occur during a transition period.

SUMMARY OF THE INVENTION

It is an object of the invention to provide a transmission system of the type defined in the opening paragraph, in which there can also be considerable power savings in speech pauses and in which optimum parameters for the transmission of the speech signals are available nearly forthwith when a speech signal recommences after a speech pause.

According to the invention this object is achieved in that the detector turns off the selection means in the case of speech pauses, and supplies to the filter a further signal derived from the speech signal.

According to the invented solution the addressing, reading and very costly filtering of all the stored excitation vectors is turned off when the selection means are turned off, because such operations require the most computational circuitry, and only the function of the filter arrangement for filtering the further signal is maintained because that function consumes little power. The filter arrangement will no longer receive an input signal from the memory when the addressing of the memory arrangement is turned off, but it receives a further input signal derived from the speech signal; that is to say, only a single excitation vector, because ideally the input signals of the two arrangements are to be the same. When the speech signal recommences after a speech pause, also the filter arrangement will present a smoother transition to the complete speech coding then used again.

For obtaining optimum parameters for the transmission of the speech signals, it is known to employ a memory which consists of a first sub-memory containing defined excitation vectors and a second sub-memory containing additional excitation vectors, which additional excitation vectors are formed not only by speech pauses but also by the sum of a weighted excitation vector of the first sub-memory and a weighted excitation vector of the second sub-memory, and are written in the second sub-memory. The use of the additional excitation vectors achieves that near-optimum excitation vectors are obtained which produce a very small difference signal, i.e. a small error signal. This is particularly effective in voiced speech sections, because then the speech signal is almost periodic and hardly ever changes abruptly. This is basically also the case when a speech signal recommences after a speech pause. Therefore, to have most recent values as excitation values also in speech pauses, which most recent values can be used immediately after the speech signal has recommenced, it is suitable according to an embodiment of the invented method that during speech pauses the additional excitation vectors are taken off from the input of the first part of the second filter arrangement and are written in the second sub-memory. As a result, additional excitation vectors are available in the second sub-memory when the speech signal is recommenced, which excitation vectors make it possible even at that instant to determine near-optimum parameters for the transmission of the speech signals.

BRIEF DESCRIPTION OF THE DRAWINGS

Embodiments of the invention will be further explained hereinafter with reference to the drawings, in which.

DESCRIPTION OF THE PREFERRED EMBODIMENTS

Figure 1:
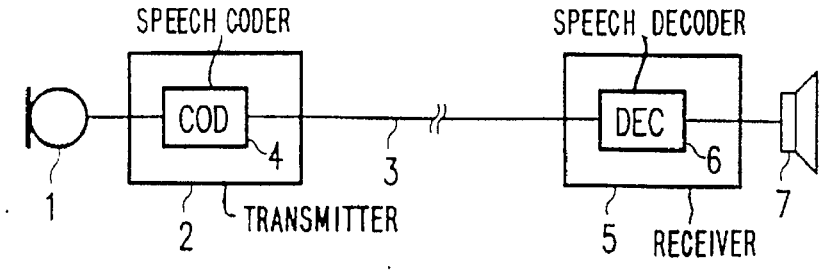
FIG. 1 shows a transmission system in which the invention can be used.

In the transmission system shown in FIG. 1 a speech signal produced by a microphone 1 is transformed by the speech coder 4 in the transmitter 2 into a coded speech signal. The coded speech signal is transmitted by the transmitter 2 to the receiver over the transmission link 3. The transmission link may be, for example, a radio link, a pair of copper wires or a glass fibre. In the receiver 5 the coded speech signal is transformed by the decoder 6 into a reconstructed speech signal which is transformed into an acoustic signal by the loudspeaker 7.

Figure 2:
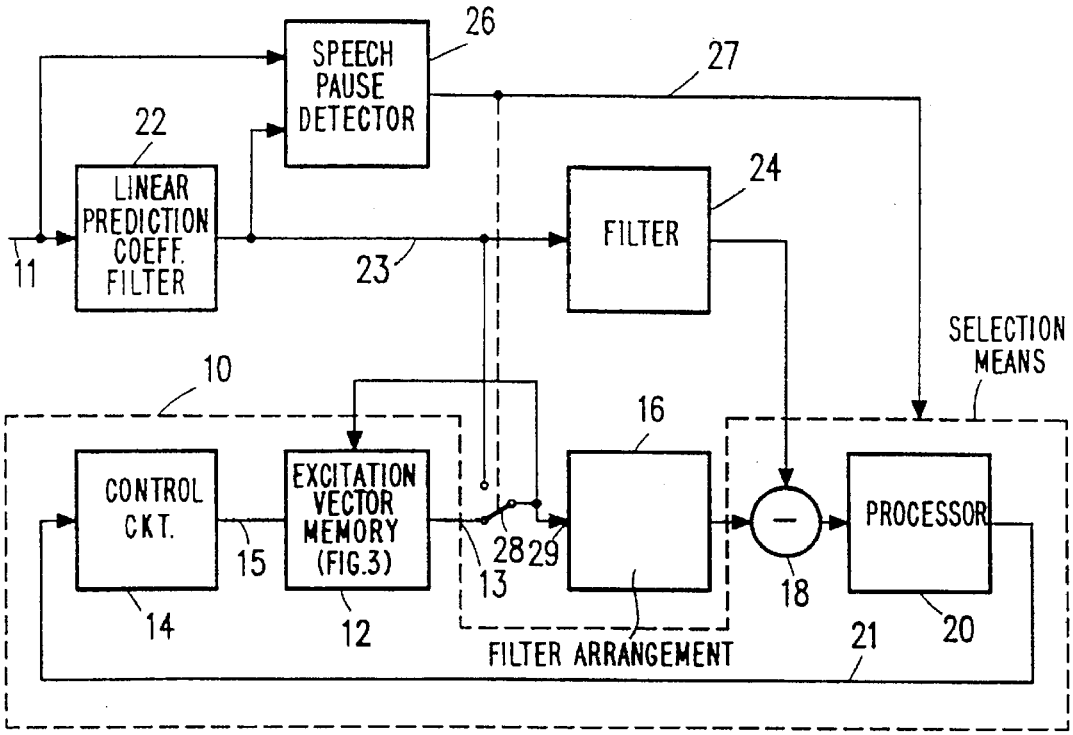
FIG. 2 shows a block circuit diagram of a speech coder in a transmitter station.

The speech coder shown in FIG. 2 comprises a memory arrangement 12 which receives addresses and control signals from a control circuit 14 over a link 15. The memory arrangement 12 contains different excitation vectors in a number of memory locations which are periodically and successively controlled and read by the control circuit 14. The excitation vectors that have been read appear on line 13 after a weighting stage which is not shown here in detail, which line 13 is connected to a terminal of a change-over switch 28. This change-over switch is obviously an electronic switch. There is first assumed that the switch 28 is in the lower state, so that the excitation vectors which have been weighted and read on line 13 are applied to an input 29 of a first filter arrangement 16.

The digitized speech signal to be coded is applied to an input 11 which is connected to a filter 22. For clarity there is not shown an arrangement for deriving various parameters from the speech signal, especially for deriving LPC coefficients. These LPC coefficients are applied to the filter 22 (LPC analysis filter) which filter, as a result, produces the so-called residual signal on line 23. Such residual signals represent excitation vectors which also are stored in the memory arrangement 12.

The residual signal on line 23 is applied to a filter 24 which has a like structure to filter arrangement 16 and also uses the same filter coefficients. The output signals of filters 16 and 24 are applied to a difference forming stage 18 which forms the difference between the two signals and this difference signal is also denoted an error signal because this difference signal is a measure of the difference between the speech signal on input 11 and a speech signal recovered from the stored excitation vectors. This difference signal is applied to a processing unit 20 which forms the average energy of the error signal. This average energy is applied over line 21 to the control circuit 14 which retains the address of the excitation vector for which the smallest average energy is found. This address is transmitted to the receiver station as a parameter of the speech signal to be transmitted.

Furthermore, a detector 26 is provided which receives both the speech signal applied to the input 11 and the residual signal produced on line 23 and, on the basis thereof, decides whether there is a real speech signal on input 11 or whether at that very moment there is a speech pause in which only background noise is applied to the input 11. If the detector 26 detects a speech pause, a signal is transmitted over line 27, which signal turns off the selection means 10 formed by the control circuit 14, the memory arrangement 12, the difference forming stage 18 and the processing arrangement 20. In that case the filter arrangement 16 would no longer receive excitation vectors; however, the signal on line 27 also actuates the change-over switch 28, so that then the input 29 of the filter arrangement 16 is supplied with the residual signal on line 23. This signal largely corresponds to the optimum excitation vector which is produced each time over the line 13, thus only a single excitation vector each time. If, after this, a speech signal again occurs on input 11 and the elements of selection means 10 are turned on again and the change-over switch 28 is returned to the lower state, the filter 16 receives over line 13 again all the stored and weighted excitation vectors from which the optimum one is to be selected.

Figure 3:
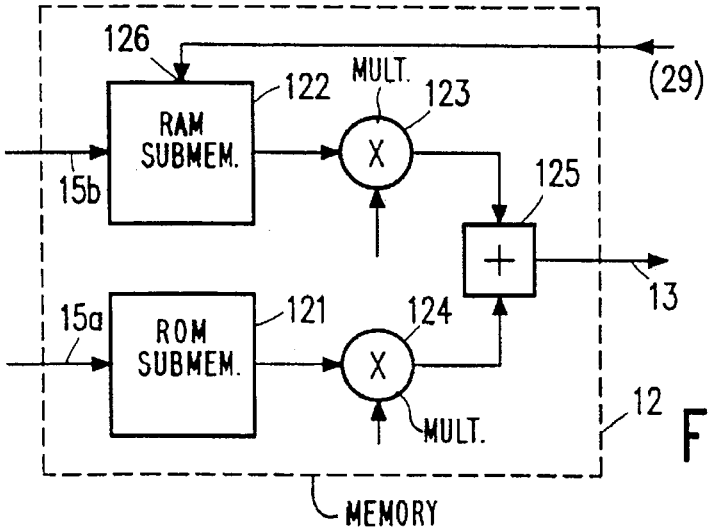
FIG. 3 shows the structure of the memory arrangement comprising two sub-memories.

The input 29 of the filter 16 is further connected to a data input of the memory arrangement 12. As shown in FIG. 3 the memory arrangement 12 is actually formed by two sub-memories 121 and 122 which are driven by the control circuit 14 in FIG. 1 via respective address inputs **15*a* and 15*b*. The sub-memory 121 is generally a read-only memory which contains a number of fixedly stored excitation vectors. The sub-memory 122, on the other hand, is a random-access memory which receives on an input 126 the most recently produced optimum excitation vector from line 13. The excitation vector on line 13 is formed by a summator 125 which determines the sum of an excitation vector from the sub-memory 121, which is multiplied by a first weighting coefficient in a multiplier 124, and an excitation vector from the second sub-memory 122 which is multiplied by a generally different weighting coefficient in a further multiplier 123. The first sub-memory 121** may also comprise a plurality of read-only memories which are switched to in response to a detection of a voiced/voiceless element in the speech signal.

As the memory arrangement 12 in FIG. 1 is turned off during speech pauses, no excitation vectors will be generated on line 13 during that period of time. The data input 126 of the second sub-memory 122 in FIG. 3 is therefore directly connected to the input 29 of the filter arrangement 16, which input also receives a signal during speech pauses, i.e. the residual signal on line 23. In this manner the second sub-memory 122 contains the most recent excitation vectors also in speech pauses, so that when a speech signal is switched over to, practically simultaneously a sequence of near-optimum excitation vectors is received on line 13.

We claim:

1. A transmitter which includes a coder for coding a speech signal which is input thereto for transmission by said transmitter, said coder comprising:

a memory arrangement for storing pre-defined excitation vectors corresponding to a plurality of possible waveforms of the speech signal;

linear prediction filter means for receiving said speech signal and producing an excitation vector corresponding thereto, and further producing during pauses in said speech signal a further excitation vector derived from said speech signal;

a filter arrangement for filtering excitation vectors output from said memory arrangement;

selection means for comparing the excitation vector derived from said speech signal with the stored excitation vectors, and based on said comparisons determining an optimum one of the stored excitation vectors; and detecting means for detecting pauses in said speech signal and during each pause (i) turning off said selection means, and (ii) supplying said filter arrangement with the further excitation vector produced by said linear prediction filter means;

whereby despite turn-off of said selection means during speech pauses said filter arrangement is maintained in condition to immediately resume filtering of excitation vectors supplied by said memory arrangement following each of said speech pauses.

2. A transmitter as claimed in claim 1, wherein:

said memory arrangement comprises a first sub-memory wherein said predefined excitation vectors are stored and a second sub-memory for storing at least one additional excitation vector; and said coder further comprises means for writing into said second sub-memory during pauses in said speech signal excitation vectors derived from said speech signal, and during said speech signal (i) deriving from said first and second sub-memories the sum of weighted proportions of excitation vectors respectively stored therein, and (ii) supplying said sum as an input excitation vector to said filter arrangement for filtering thereby.

3. A mobile radio set comprising a transmitter as claimed in claim 1.

4. A mobile radio set comprising a transmitter as claimed in claim 2.

5. A method of transmitting a speech signal, comprising the steps of:

storing in a memory arrangement a plurality of predefined excitation vectors which respectively correspond to a plurality of possible waveforms of the speech signal;

receiving said speech signal and deriving therefrom an excitation vector corresponding thereto, and further deriving during pauses in said speech signal a further excitation vector derived from said speech signal;

filtering excitation vectors which are output from said memory arrangement;

comparing the excitation vector derived from said speech signal with the stored predefined excitation vectors and based on said comparisons determining an optimum one of the stored excitation vectors; and detecting pauses in said speech signal and during each pause (i) ceasing said comparison of excitation vectors and said determination of an optimum stored excitation vector, and (ii) filtering said further excitation vector derived from said speech signal;

whereby the maintenance of filtering during speech pauses enables filtering of excitation vectors output from said memory arrangement to be resumed without delay upon termination of each speech pause.

6. A method as claimed in claim 5, further comprising:

storing said predefined excitation vectors in a first sub-memory;

storing the excitation vector derived from said speech signal in a second sub-memory; and during said speech signal deriving the sum of weighted proportions of the excitation vectors stored in said first and second sub-memories and supplying said sum as an output excitation vector from said memory arrangement.

* * * * *